United States Patent [19]

Draw

[11] 4,112,255

[45] Sep. 5, 1978

[54] ROTA-PHONIC SYSTEM FOR STEREO QUADROPHONIC SOUND SYSTEM

[75] Inventor: Warren A. Draw, Detroit, Mich.

[73] Assignee: Elizabeth Draw, Detroit, Mich. ; a part interest

[21] Appl. No.: 798,069

[22] Filed: May 18, 1977

[51] Int. Cl.[2] ..... H04R 5/00

[52] U.S. Cl. ..... 179/1 GQ

[58] Field of Search ..... 179/1 GQ, 1 G, 1 GP, 179/100.1 TD, 100.4 ST

[56] References Cited

U.S. PATENT DOCUMENTS

| | | | |
|---|---|---|---|
| 3,757,046 | 9/1973 | Williams | 179/1 GQ |
| 3,873,779 | 3/1975 | Wedan | 179/1 GQ |
| 3,969,588 | 7/1976 | Raydon et al. | 179/1 GQ |
| 3,982,071 | 9/1976 | Weiss et al. | 179/1 GQ |
| 4,002,836 | 1/1977 | Gardner | 179/1 GQ |

FOREIGN PATENT DOCUMENTS

| | | | |
|---|---|---|---|
| 2,341,342 | 2/1975 | Fed. Rep. of Germany | 179/1 GQ |

*Primary Examiner*—Douglas W. Olms
*Attorney, Agent, or Firm*—Cullen, Settle, Sloman & Cantor

[57] ABSTRACT

In a quadrophonic sound arrangement having a panel with a series of sound outputs connected to a series of speakers, and a series of sound channel inputs, a rotaphonic system which comprises a series of circuits interconnecting each input respectively to each one of the outputs. A continuously operated circuit control is interposed in said circuits for progressively changing the circuits for switching each channel input in a sequence form a connected speaker to the successive adjacent speaker, so that over a predetermined interval, each input is successively connected, one at a time, into each output. The circuits and circuit control includes a mechanical device for switching circuits. A modification includes a solid state electronic circuit between inputs and outputs with the circuit control including a series of trigger circuits and an associated trigger switch.

10 Claims, 6 Drawing Figures

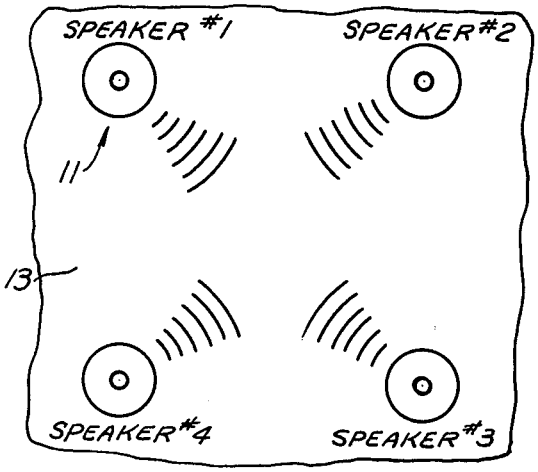
FIG. 1
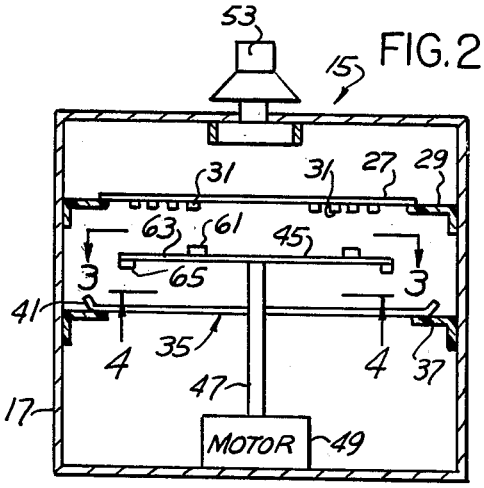
FIG. 2
FIG. 5
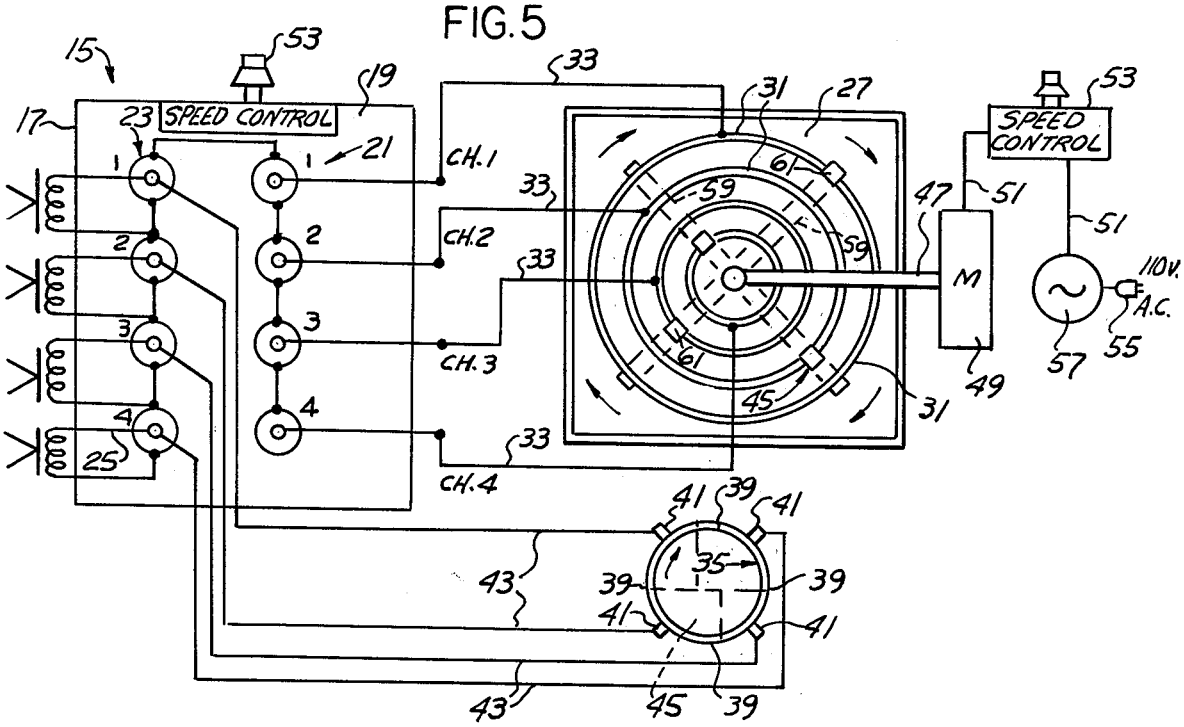
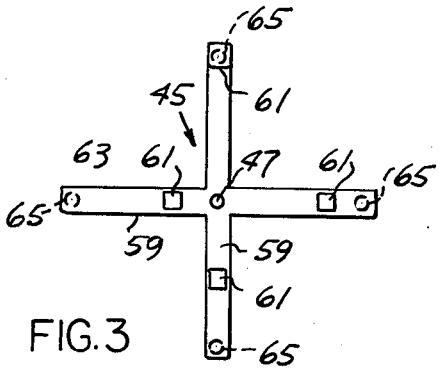
FIG. 3
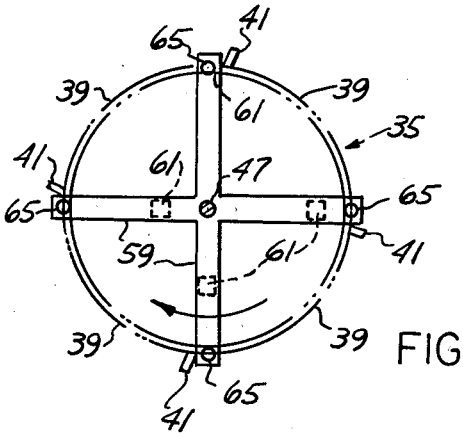
FIG. 4

ROTA-PHONIC SYSTEM FOR STEREO QUADROPHONIC SOUND SYSTEM

BACKGROUND OF THE INVENTION

Heretofore, it is known in connection with quadrophonic sound arrangements the provision of a series of sound outputs, with the outputs respectively connected to a series of different spaced speakers. Also included is a series of channel inputs for receiving a variety of channel signals from a stereo record or tape or the like, and incorporated into the circuit connections between said inputs and outputs so that each of the individual channel inputs is respectively connected to one of a series of four speakers arranged around a room area.

The general subject pertaining to quadrophonic sound is shown in U.S. Pat. No. 3,794,780. In that Patent, there is considered the advisability and advantages of providing a means by which separate input signals from different sources from an orchestra or other source of music are provided to separate and independent speakers so spaced as to give a blended audible affect with emanating from different speakers.

SUMMARY OF THE INVENTION

It is an object of the present invention to provide a rota-phonic sound system which incorporates a series of circuits connected to a series of sound inputs for connecting each of a series of different channel sources to each one of a series of speaker outputs, and in conjunction therewith a continuously operated circuit control for progressively changing said circuits for switching each channel source progressively in a sequence from a connected one speaker to a successive adjacent speaker over a predetermined interval and wherein all four speakers are producing sound at all times approximately.

It is another object of the present invention to provide a mechanically operated circuit control for switching circuits.

It is a further object to provide a solid state electronic circuit logic which incorporates a series of circuits connecting individual channel sources to respective individual speakers and incorporating a series of trigger circuits for energizing the individual circuits for successively changing one channel source signal from one speaker to the next adjacent speaker, and simultaneously changing each of the other channel sources from one speaker to successively adjacent speakers in a continuous rotary effect whereby the individual respective sound signals progressively move from one speaker to the other in a complete circle gradually fading into and out of the individual speakers.

It is a further object to provide for a quadrophonic sound arrangement which has a panel with a series of independent electrical sound inputs and a corresponding series of independent sound outputs, a corresponding series of selectably located speakers connected respectively to each of said outputs and a corresponding series of different sound channel sources or signals connected respectively to each of said inputs for feeding to the speakers simultaneously. Provided for such quadrophonic sound arrangment is the present rota-phonic system comprising a series of circuits which connect the respective inputs from the individual channel sources to each one of the speaker outlets and which incorporates a continuously operated circuit control for progressively changing said circuits for switching each channel source in a sequence from a connected one speaker to a successive adjacent speaker whereby, over a predetermined interval, each channel input has been successively and progressively connected, one at a time, to each of the said speaker outputs, in unison.

These and other objects will be seen from the following specification and claims in conjunction with the appended drawing.

THE DRAWING

FIG. 1 is a schematic view of a quadrophonic sound arrangement incorporating a series of speakers spaced apart within a room area.

FIG. 2 is a vertical section of a housing for the present rota-phonic system.

FIG. 3 is a plan view of a quad dial shown in FIG. 2 taken in the direction of arrows 3—3 of FIG. 2.

FIG. 4 is a fragmentary plan view of the opposite side of the quad dial taken in the direction of arrows 4—4 of FIG. 2.

FIG. 5 is a schematic wiring diagram illustrating the circuit and arrangement of the present quadrophonic sound arrangement and the connected rota-phonic control system and the circuitry therefor.

Figure 6:
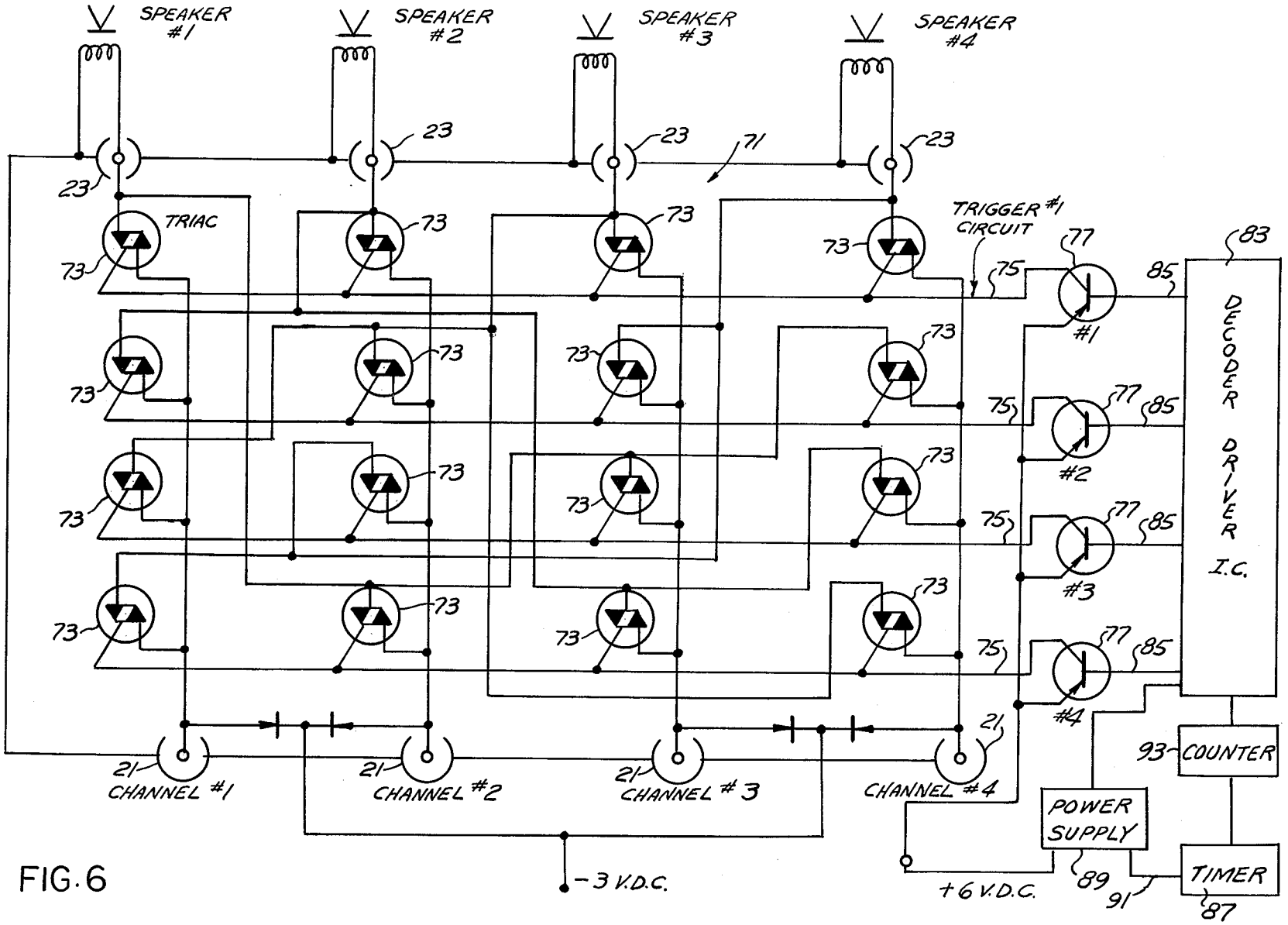
FIG. 6 is a wiring diagram of a modificaton in solid state of the present rota-phonic system.

It will be understood that the above drawings illustrate several embodiments of the present invention, and that other embodiments are contemplated within the scope of the claims hereafter set forth.

DETAILED DESCRIPTION OF THE INVENTION

Referring to the drawings, FIG. 1 generally shows at 11 a quadrophonic sound arrangement within the room 13, schematically indicated, within which are spaced apart adjacent the corners of said room a series of speakers: 1, 2, 3 and 4, also shown schematically in FIGS. 5 and 6.

The present rota-phonic system is generally indicated at 15 and includes a housing 17 shown in vertical section in FIG. 2 having upon one wall thereof an upright panel 19, FIG. 5, which has upon one side thereof a series of spaced input jacks 21, numbered 1, 2, 3 and 4, and a corresponding series of sound output jacks 23, numbered 1, 2, 3 and 4.

A series of individual lead wires 25 interconnect the respective output jacks 23 with the corresponding speakers schematically shown and indicated at S*p*1, S*p*2, S*p*3 and S*p*4.

Mounted and disposed within said housing is a stationary insulated quad plate 27 supported upon brackets 29 and having mounted upon its undersurface a series of circular concentric conductors 31.

The series of circuits which makes up the present rota-phonic system includes the lead wires 33 which interconnect the respective sound input jacks 21 with the corresponding series of conductors 31, FIG. 5.

A potentiometer-type of balancing ring 35 of conductive material is disposed within said housing spaced below the quad plate 27 and supported upon insulating brackets 37 within said housing. The balancing ring is divided into a series of quadrants 39 and connected with each quadrant is a contact 41. The present series of circuits includes the lead wires 43 which respectively interconnect contacts 41 on the balancing ring with corresponding individual output jacks 23 as shown in FIG. 5.

Interposed between the quad plate 27 and the balancing ring 35 is the power-rotated quad dial 45 but with exaggerated spacing merely for illustration. Quad dial 45 is centrally mounted on output shaft 47 of the electric motor 49 supported within said housing. Said motor is a low RPM clock-type of motor which provides an output to said shaft in the range of 5 to 60 RPM, for illustration.

As shown in FIG. 5, the motor is connected by the lead wire 51 to the speed control 53. The circuit includes plug 55 for connection to 110 volt AC power source with light bulb 57 interposed to visibly indicate when the motor 49 is energized. The speed control, for illustration, may be an SCR standard light dimmer further shown upon the housing at 53, FIG. 2.

The present quad dial normally closely interposed between quad plate 27 and balancing ring 35 has the four right-angularly related electrically-conductive arms 59, FIGS. 3 and 4. As shown in FIG. 3, on the top side of the respective arms and at varying center distances are the series of first arm contacts 61 which, as shown in FIG. 5, are spaced radially outward at different distances so as to be in continuous sweeping contact with corresponding respective conductors 31 upon the undersurface of the quad plate 27. Insulators 63 are provided upon the corresponding surface of the arms so that an arm does not accidentally contact one of the other conductors.

A series of second contacts 65 are arranged upon the undersurface of each of the respective arms 59 and these contacts are at all times in continuous sweeping engagement for movement over the potentiometer-type of balancing ring 35 shown in FIGS. 2, 4 and 5.

Referring to FIG. 5, the series of circuits which provide the respective connections between input jacks 21 and output jacks 23 upon the panel 19, include the leads 33 to the respective spaced and insulated conductors 31, the contacts 61 ad 65 upon opposite sides of the quad dial arms for connection to balancing ring 35 and the lead wires 43 to channel outputs 23 respectively to the series of speakers *Sp*1, *Sp*2, *Sp*3 and *Sp*4.

In connection with the series of circuits there is incorporated thereinto the present circuit control, of the mechanical type, and wherein, said circuit control includes the arms 59 of quad dial 45, the spaced contacts 61 on one side of said arms and the additional second contact 65 upon the other side thereof, the balancing ring 35, and contacts 41 from the respective quadrants thereof.

OPERATION

In operation, the mechanical embodiment shown in FIGS. 1 through 5 is in the nature of a four-way balance control and wherein, all four speakers are producing sound at all times. This much could be accomplished in quadrophonic sound arrangement in a coventional circuitry. However, the present rota-phonic system provides the series of circuits above described with the motor-operated quad dial 45 by which an individual channel input signal, first connected to one speaker, is progressively switched to the next adjacent speaker.

At the same time, the corresponding additional input signals, such as to the other inputs in the first instance connected to others of the speakers *Sp*1, *Sp*2, *Sp*3 and *Sp*4, are simultaneously moved to the next adjacent speaker. Accordingly, the speakers are constantly on at all times with the channel output for each speaker continuously changing due to the rotary movement of the quad dial 45.

For illustration, if we started with channel 1 coming from speaker 1, channel 2 coming from speaker 2, channel 3 coming from speaker 3 and channel 4 coming from speaker 4, the rota-phonic system herein smoothly and gradually changes channel 1 to speaker 2, channel 2 to speaker 3, channel 3 to speaker 4 and channel 4 to speaker 1. (Thus, the present rota-phonic system has shifted each channel to another speaker but in a sequence that suggsts rotation.) The direction of rotation, in the illustrative embodiment shown in FIGS. 4 and 5 is clockwise, as shown by the arrows.

When the channels shift to different speakers, it is not a sudden shift but rather a fade-in as the respective arms 59 register with the balancing ring contacts 41, and a fade out as the arms move with their corresponding contacts 65 away from the quadrant contacts 41. Thus, the sound slides or fades from left to right in a gradual but continuous manner. A complete change is accomplished in a time interval determined by adjustment of the speed control 53. Normally, this speed would range between 5 and 60 RPM, and preferably at the lower or midrange.

The present rota-phonic system includes within the housing 17 the basic elements; namely, the quad plate 27 having a series of separate concentric conductors 31, each for receiving a different channel input signal; the balancing ring 35 having a series of quadrants 39 with the individual spaced contacts 41 of each quadrant connected by the leads 43 to the corresponding output jacks 23 leading to the series of speakers 1, 2, 3 and 4 interposed between the quad plate and its conductors 32 and the balancing ring 35 is the motor-operated continuously rotatable quad dial. This completes the circuit whereby, in the illustrative embodiment, each of the four input channel signals are individually transmitted to a separate one of the four speakers respectively and upon rotation of the quad dial, there is a progressive change of the channel inputs from one speaker to the next adjacent speaker in a rotative fashion so that the channel sources, in effect, rotate in a clockwise direction around the room shown in FIG. 1.

MODIFICATION

The present rota-phonic system also includes a solid state arrangement shown in FIG. 6 which incorporates the logic circuit 71 by which each of the individual channel inputs 21 corresponding to inputs 21 of FIG. 5 are individually connected to each of the channel outputs 23 corresponding to the output jacks 23 of FIG. 5 for direction to each of the individual speakers 1, 2, 3 and 4. Interposed in the logic 71 are the plurality of normally open thyristor triac-switches 73 so that there is, in effect, a power circuit from each of the individual channels 1, 2, 3 and 4 at 21 to each of the individual speakers 1, 2, 3 and 4, FIG. 6.

Circuit control for the circuits to the respective speakers includes a series of parallel trigger circuits 75. Each of these circuits is connected to the respective series of thyristors so that when a particular one of the four trigger circuits 75 is energized, such as the trigger circuits 1, 2, 3 and 4 of FIG. 6, one at a time, there will be determined the direction of the individual channel sources 1, 2, 3 and 4, to each of the four speakers 1, 2, 3 and 4.

For example, referring to FIG. 6, if the trigger circuit 1 shown at 75 is energized, to the exclusion of the other three trigger circuits, then the adjacent speakers 1, 2, 3 and 4 will be connected respectively to the corresponding channels 1, 2, 3 and 4.

Each of the individual trigger circuits 75 includes a switch device, such as transistor 77. Accordingly, each of the trigger circuits functions when supplied an electrical impulse from the trigger switch or decoder drive 83 connected to the individual respective transistor by the leads 85.

The decoder drive has connected thereto an electronic timer 87 joined to a 6-volt DC power source 89 by the lead 91. The timer may be a solid state I.C. I.C. counter 93 interconnects said timer and decoder drive 83.

When energized, the timer 87 is continuously operating and, therefore, the output through the leads 85 to the respective trigger circuits when energized will be at different IC output corresponding to the input of the individual trigger circuits. Accordingly, upon continuous operation of the trigger switch and its electronic timer, the respective trigger circuits 75 will be energized one at a time and successfully switching from one circuit to the next circuit over a predetermined timed interval and, wherein the same result is achieved by the solid state arrangement as accomplished by the mechanical arrangement shown in FIGS. 1 and 5; namely, the switching of the respective channel sources 1, 2, 3 ad 4, initially set forth a corresponding set of speakers 1, 2, 3 and 4 to be advanced through the next adjacent speakers in a successive manner. Accordingly, by this solid state arrangement, furthermore, the channels signal 1 will be progressively advanced from one speaker to the next adjacent speaker and simultaneously the respective speakers connected with the other channels 2, 3 and 4 will be similarly advanced to provide the same rotational sound effect.

In the embodiment of FIGS. 1 through 5, the sound fades in and out. In the electronic embodiment of FIG. 6, changes occur without such fading.

While there is shown a conductive ring 35 in FIG. 5, it is contemplated as equivalent that the ring could be replaced with a copper plate with suitable contacts 41. Ring 35 is of a resistive material such as a plastic carbon alloy. Thus, there is a maximum resistance at the central portions of the ring sectors 39 and a minimum resistance at contacts 41.

The quad plate 27, quad dial 45 and balancing ring 35, of FIGS. 2 and 5, as a group define a quad potentiometer. The 16 triacs 73 or thyristors of FIG. 6, as a group are referred to as a quad plex.

Having described my invention, reference should now be had to the following claims.

I claim:

1. In a quadrophonic sound arrangement having a panel having a series of independent electrical sound outputs, a corresponding series of independent sound inputs, a corresponding series of selectively located speakers connected respectively to each of said outputs, a corresponding series of different sound channel sources connected respectively to each of said inputs adapted for feeding said speakers simultaneously;

a rota-phonic system comprising a corresponding series of circuits connected to said inputs for connecting each one of said channel sources to each one of said speaker outputs;

and a continuously operated circuit control for progressively changing said circuits for switching each channel source in a sequence from a connected one speaker to the successive adjacent speaker, whereby over a predetermined interval, each channel input has been successively and progressively connected, one at a time, to each of said speaker outputs;

said speakers adapted to be located adjacent the four corners of a room, and the series of circuits being so regulated by said circuit control that each of the channel sources are progressively and successively connected to the respective speakers, one by one so that the individual channel sources are, in effect, continuously rotated around the room containing said speakers;

a housing for said panel;

said series of circuits including an insulating quad plate mounted within said housing;

a corresponding series of concentric circular conductors upon said plate;

each conductor connected to one of said inputs;

a potentiometer-type of balancing ring parallel to and spaced from said quad plate and having a series of quadrants, each quadrant having a contact connected to one of said outputs respectively;

a conductive quad dial rotatively disposed between said quad plate and balancing ring, in the form of a cross, with right-angularly related conductive arms, corresponding to said quadrants, each arm of said dial having a first contact on one side in continuous registry with each of said circular conductors respectivey;

each arm upon its other side having a second contact connected to its first contact, in continuous engagement with and spaced around and movable over said balancing ring;

and a motor means on said housing connected to said quad dial for continuously rotating said dial at a uniform speed.

2. In the quadrophonic sound arrangement of claim 1, said motor means including a motor having an output shaft centrally connected to said quad dial.

3. In the quadrophonic sound arrangement of claim 1, an electric power source; and a manual speed-control potentiometer (SCR = Silicon-controlled rectifier) interposed in a circuit between said power source and motor.

4. In the quadrophonic sound arrangement of claim 1, said uniform speed being adjustable between 5 and 60 RPM approximately.

5. In the quadrophonic sound arrangement of claim 1, said quad dial arms as they progressively move over said potentiometer produce maximum volume of a sound channel to one speaker as the corresponding arm reaches its quadrant contact, and in moving toward and away from said contact provides a gradual fade-in and fade-out from said maximum.

6. In a quadrophonic sound arrangement having a panel having a series of independent electrical sound outputs, a corresponding series of independent sound inputs, a corresponding series of selectively located speakers connected respectively to each of said outputs, a corresponding series of different sound channel sources connected respectively to each of said inputs adapted for feeding said speakers simultaneously;

a rota-phonic system comprising a corresponding series of circuits connected to said inputs for connecting each one of said channel sources to each one of said speaker outputs;

and a continuously operated circuit control for progressively changing said circuits for switching each channel source in a sequence from a connected one speaker to the successive adjacent speaker, whereby over a predetermined interval, each channel input has been successively and progressively connected, one at a time, to each of said speaker outputs;

said speakers adapted to be located adjacent the four corners of a room, and the series of circuits being so regulated by said circuit control that each of the channel sources are progressively and successively connected to the respective speakers, one by one so that the individual channel sources are, in effect, continuously rotated around the room containing said speakers;

said series of circuits being in a solid state wherein, each of said channel inputs is electrically connected to each of said speakers through an intervening thyristor;

said circuit control including a corresponding series of trigger circuits corresponding to the number of speakers, each circuit including a series of thyristors, one thyristor for each speaker;

and connected so that upon energization of one trigger circuit, each of the thyristors therein connected to the different speakers will be energized, activating all speakers for transmitting a different channel input to each speaker, each of the different circuits when successively energized respectively, connecting each of said channels to a progressively different speaker;

and a trigger switch connected to a power source and having a power contact adapted for delivering power at a corresponding different outputs, activating said circuits progressively and one at a time;

and a timer connected to said trigger switch for automatically and progressively connecting each one channel to each speaker respectively and for progressively switching said channels to successive speakers in a continuous manner.

7. In the quadrophonic sound arrangement of claim 6, each of said trigger circuits having a switch device therein corresponding to the various selectively delivered outputs of said trigger switch, so that the trigger circuits are energized progressively, one at a time.

8. In the quadrophonic sound arrangement of claim 1, said switch device including a transistor, the energization of each one of said trigger circuits rendering the thyristors therein conductive for energizing all of said speakers simultaneously in one trigger circuit.

9. In the quadrophonic sound arrangement of claim 8, said trigger switch including a solid state I.C. decoder driver and counter.

10. A rota-phonic balancing device adapted for connecting a series of independent sound channel inputs to a corresponding series of different output speakers, with each speaker receiving one output, and for progressively changing each channel input to a different speaker, so that each channel input is transferred to each of said speakers progressively;

comprising a housing;

a panel on the housing having a series of independent electrical sound outputs and a corresponding series of independent sound inputs;

a quad plate mounted within said housing;

a series of concentric circular conductors mounted on said plate in insulated relation, each conductor connected to one of said inputs;

a potentiometer-type of balancing ring parallel to and spaced from said quad plate and having a series of quadrants, each quadrant having a contact connected to one of said outputs respectively;

a conductive quad dial rotatively disposed between said quad plate and balancing ring in the form of a cross, with right-angularly related conductive arms, corresponding to said quadrants, each arm of said dial having a first contact on one side in continuous registry with one of said circular conductors respectively;

each arm upon its other side having a second contact connected to its first contact, in continuous engagement with and spaced around and movable over said balancing ring;

and motor means on said housing connected to said quad dial for continuous rotating said dial at a pre-set uniform speed.

* * * * *